US010513815B2

(12) United States Patent
Kim et al.

(10) Patent No.: US 10,513,815 B2
(45) Date of Patent: Dec. 24, 2019

(54) CLOTHES-HANDLING APPARATUS AND METHOD FOR CONTROLLING CLOTHES-HANDLING APPARATUS

(71) Applicant: LG ELECTRONICS INC., Seoul (KR)

(72) Inventors: Keunjoo Kim, Seoul (KR); Byungkeol Choi, Seoul (KR); Seungchul Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 212 days.

(21) Appl. No.: 15/522,264

(22) PCT Filed: Jun. 8, 2015

(86) PCT No.: PCT/KR2015/005708
§ 371 (c)(1),
(2) Date: Apr. 26, 2017

(87) PCT Pub. No.: WO2016/072578
PCT Pub. Date: May 12, 2016

(65) Prior Publication Data

US 2017/0314180 A1 Nov. 2, 2017

(30) Foreign Application Priority Data

Nov. 3, 2014 (KR) ..... 10-2014-0151353

(51) Int. Cl.
*D06F 33/02* (2006.01)
*D06F 37/22* (2006.01)

(52) U.S. Cl.
CPC ..... *D06F 37/225* (2013.01); *D06F 33/02* (2013.01)

(58) Field of Classification Search
CPC ..... D06F 37/225; D06F 37/20; D06F 37/203; D06F 33/02
See application file for complete search history.

(56) References Cited

U.S. PATENT DOCUMENTS 2,534,269 A * 12/1950 Ellner ..... D06F 37/225 210/144
5,893,280 A 4/1999 Honda et al.
(Continued)

FOREIGN PATENT DOCUMENTS

| | | |
|---|---|---|
| EP | 2 025 797 | 2/2009 |
| KR | 10-0224449 | 10/1999 |
| KR | 10-2014-0102014 | 8/2014 |

OTHER PUBLICATIONS

European Search Report dated Jun. 21, 2018 issued in Application No. 15857531.6.
(Continued)

*Primary Examiner* — David G Cormier
(74) *Attorney, Agent, or Firm* — KED & Associates, LLP

(57) ABSTRACT

Provided is a control method for a laundry treating apparatus comprising: a drum in which laundry is stored; at least three balancers fixed to the drum and provided to be spaced from each other at the same angle with respect to the rotational center of the drum; front spaces provided in each balancer and positioned at the front of the drum; and rear spaces provided in each balancer and positioned at the rear of the drum, wherein the control method for the laundry treating apparatus comprises: a rear control step of supplying a liquid to at least one of the rear spaces so as to increase the weight of a quadrant (first target quadrant) positioned in the direction opposite to a quadrant, of a circumferential surface of the drum, to which a force causing unbalance is directed; and a front control step of supplying a liquid to at least one of the front spaces so as to increase the weight of a quadrant
(Continued)

(second target quadrant) positioned in the direction opposite to the quadrant, of the circumferential surface of the drum, to which the force causing unbalance is directed.

20 Claims, 10 Drawing Sheets

(56) References Cited

U.S. PATENT DOCUMENTS

| | | | | |
|---|---|---|---|---|
| 2012/0144874 | A1 | 6/2012 | Erickson et al. | |
| 2012/0144879 | A1 | 6/2012 | Verma | |
| 2013/0061639 | A1* | 3/2013 | Hasanreisoglu ..... | D06F 37/06 68/12.06 |
| 2014/0223969 | A1 | 8/2014 | Kim et al. | |

OTHER PUBLICATIONS

International Search Report (with English Translation) and Written Opinion dated Aug. 28, 2015 issued in Application No. PCT/KR2015/005708.

* cited by examiner (a)

(b)

(a)

(b)

(a)

(b)

(a)

(b)

(a)

(b)

(a)

(b)

CLOTHES-HANDLING APPARATUS AND METHOD FOR CONTROLLING CLOTHES-HANDLING APPARATUS

CROSS-REFERENCE TO RELATED PATENT APPLICATIONS

This application is a U.S. National Stage Application under 35 U.S.C. § 371 of PCT Application No. PCT/KR2015/005708, filed Jun. 8, 2015, which claims priority to Korean Patent Application No. 10-2014-0151353, filed Nov. 3, 2014, whose entire disclosures are hereby incorporated by reference.

FIELD

The present disclosure relates to a laundry treating apparatus and a control method for the same.

BACKGROUND

Generally, a laundry treating apparatus includes a cabinet defining an external appearance; a tub mounted in the cabinet; a drum rotatably provided in the tub and washing clothes or laundry; and a motor fixed to the drum by using a shaft penetrating the tub to rotate the drum.

The drum is likely to rotate while failing to keep dynamic equilibrium or dynamic balance according to the location of the laundry loaded in the drum.

The dynamic equilibrium means a state where a centrifugal force of a rotating rotary body or the moment created by the centrifugal force becomes zero with respect to a rotation axis. When mass distribution is consistent with respect to a rotation shaft, a rigid body rotating on the rotation axis keeps dynamic equilibrium.

When the drum is rotated with laundry loaded therein, it can be understood that dynamic equilibrium is kept in the laundry treating apparatus when mass distribution of laundry with respect to the shaft of the drum is within an allowable range (when the drum is rotated while vibrating within an allowable range).

Dynamic unbalance of the laundry treating apparatus means a state where mass distribution is not consistent with respect to the shaft of the drum when the drum is being rotated, in other words, where laundry is not distributed in the drum uniformly or consistently/

The drum being rotated in unbalance is vibrated by the rotation and the vibration of the drum is transferred to the tub or cabinet only to generate noise disadvantageously.

A certain conventional laundry treating apparatus includes a balancing unit for compensating the unbalance of the drum. Balancing units provided in the conventional treating apparatuses the ball or liquid balancers having balls or liquid provided in a housing fixed in the drum.

Such the unbalanced drum is characterized to be the fastest when the laundry causing the unbalance passes the lowermost point of drum rotation locus and the slowest when passing the uppermost point.

Accordingly, when a ball or liquid balancer provided in the conventional laundry treating apparatus is configured to control unbalance by moving a ball or liquid toward the lowermost point of the drum rotation locus, when the laundry causing unbalance is moved toward the uppermost point of the drum rotation locus.

However, the control method for the unbalance mentioned above cannot be expected in a transient vibration state which is before the vibration of the drum reaches a steady state.

Moreover, it is difficult for the conventional balancing unit to overcome the unbalance right away after unbalance is sensed (settle the unbalance positively).

DETAILED DESCRIPTION OF THE INVENTION

Technical Problem

To overcome the disadvantages, an object of the present invention is to address the above-noted and other problems and provide a laundry treating apparatus which is capable of positively settling unbalanced rotation (unbalance) of a drum where laundry is loaded and a control method for the same.

Another object of the present invention is to provide a laundry treating apparatus which is capable of settling the unbalance of the drum by supplying a liquid to means for agitating the laundry loaded in the drum and a control method for the same.

A further object of the present invention is to provide a laundry treating apparatus which is capable of setting even the unbalance generated in not only diameter-direction section but also a longitudinal section of the drum and a control method for the same.

Technical Solution

To achieve these objects and other advantages and in accordance with the purpose of the embodiments, as embodied and broadly described herein, a control method for a laundry treating apparatus comprising a drum in which laundry is loaded; three or more balancers fixed to the drum and spaced the same angle from each other with respect to a rotation center of the drum; a front space provided in each of the balancers and located in a front region of the drum; and a rear space provided in each of the balancers and located in a rear region of the drum, the method comprises a rear controlling step for supplying a liquid to one or more of the rear spaces so as to increase the weight of one quadrant to which a force causing unbalance is directed in a drum circumferential surface and the weight of another quadrant (a first target quadrant) located opposite to the quadrant; and a front controlling step for supplying a liquid to one or more of the front spaces so as to increase the weight of one quadrant to which a force causing unbalance is directed in a drum circumferential surface and the weight of another quadrant (a second target quadrant) located opposite to the quadrant.

The rear controlling step may comprise a first rear controlling step for supplying the liquid to some of the rear spaces so as to increase the weights of two or more different points in the drum circumferential surface located in the first target quadrant; a second rear controlling step for additionally supplying the liquid to some of the rear spaces so as to increase the weight of one point capable of minimizing the size of unbalance out of the two or more different points.

The first rear controlling step may comprise a first rear supply step for supplying a liquid to some of the rear spaces so as to increase the weight of one random first rear point in the drum circumferential surface located in the first target quadrant; and a second rear supply step for supplying a liquid to some of the rear spaces so as to increase the weight of a second rear point distant a preset first angle from the first rear point.

When a centrifugal force applied to the laundry located in the rear region of the drum with respect to the drum rotation direction is measured before a force causing unbalance, the second rear supply step may set a point distant the first angle from the first rear point in the same direction with the drum rotation direction as the second rear point.

When a centrifugal force applied to the laundry located in the front region of the drum with respect to the drum rotation direction is measured before a force causing unbalance, the second rear supply step may set a point distant the first angle from the first rear point in an opposite direction to the drum rotation direction as the second rear point.

When the unbalance measured after the second rear supply step is smaller than the unbalance measured after the first rear supply step, the first rear controlling step may further comprise a third rear supply step for supplying a liquid to some of the rear spaces to as to increase the weight of a third rear point distant the first angle from the second rear point.

The second rear controlling step may determine the size of the unbalance based on the amplitude of drum RPM.

The front controlling step may comprise a first front controlling step for supplying the liquid to some of the front spaces so as to increase the weights of two or more different points in the drum circumferential surface located in the second target quadrant; a second front controlling step for supplying the liquid to some of the front spaces so as to increase the weight of one point capable of minimizing the size of unbalance out of the two or more different points.

The first front controlling step may comprise a first front supply step for supplying a liquid to some of the front spaces so as to increase the weight of one random first front point in the drum circumferential surface located in the second target quadrant; and a second front supply step for supplying a liquid to some of the front spaces so as to increase the weight of a second front point distant a preset first angle from the first front point.

When a centrifugal force applied to the laundry located in the rear region of the drum with respect to the drum rotation direction is measured before a force causing unbalance, the second front supply step may set a point distant the second angle from the first front point in an opposite direction to the drum rotation direction as the second front point.

When a centrifugal force applied to the laundry located in the front region of the drum with respect to the drum rotation direction is measured before a force causing unbalance, the second front supply step may set a point distant the second angle from the first front point in the same direction as the drum rotation direction as the second front point.

The second rear controlling step may determine the size of the unbalance based on the amplitude of drum RPM.

The front controlling step may set a target quadrant changeable by the rear controlling step as the second target quadrant.

The front controlling step may set the same quadrant with the first target quadrant as the second target quadrant.

The laundry treating apparatus may further comprise a first passage comprising spaces partitioned off in the same number of the balancers, the spaces in communication with the front spaces of each balancer, respectively; a second passage comprising spaces partitioned off in the same number of the balancers, the spaces in communication with the rear spaces of each balancer, respectively; a first supply unit for supplying a liquid to the first passage; and a second supply unit for supplying a liquid to the second passage. When the drum is rotated to a preset first reference angle after the maximum value of drum RPM is measured, the rear controlling step may control the second supply unit to supply the liquid to the second passage while the drum is rotated to a preset second reference angle from the first reference angle. When the drum is rotated to the preset first reference angle after the maximum value of drum RPM is measured, the front controlling step may control the first supply unit to supply the liquid to the first passage while the drum is rotated to the preset second reference angle from the first reference angle. Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

Advantageous Effects

The embodiments have following advantageous effects. The laundry treating apparatus is capable of positively settling unbalanced rotation (unbalance) of a drum where laundry is loaded and a control method for the same.

Furthermore, the laundry treating apparatus is capable of settling the unbalance of the drum by supplying a liquid to means for agitating the laundry loaded in the drum and a control method for the same.

Still further, the laundry treating apparatus is capable of setting even the unbalance generated in not only diameter-direction section but also a longitudinal section of the drum and a control method for the same.

DESCRIPTION OF SPECIFIC EMBODIMENTS

Description will now be given in detail according to exemplary embodiments disclosed herein, with reference to the accompanying drawings. For the sake of brief description with reference to the drawings, the same or equivalent components may be provided with the same reference numbers, and description thereof will not be repeated. In the present disclosure, that which is well-known to one of ordinary skill in the relevant art has generally been omitted for the sake of brevity. The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

Figure 1:
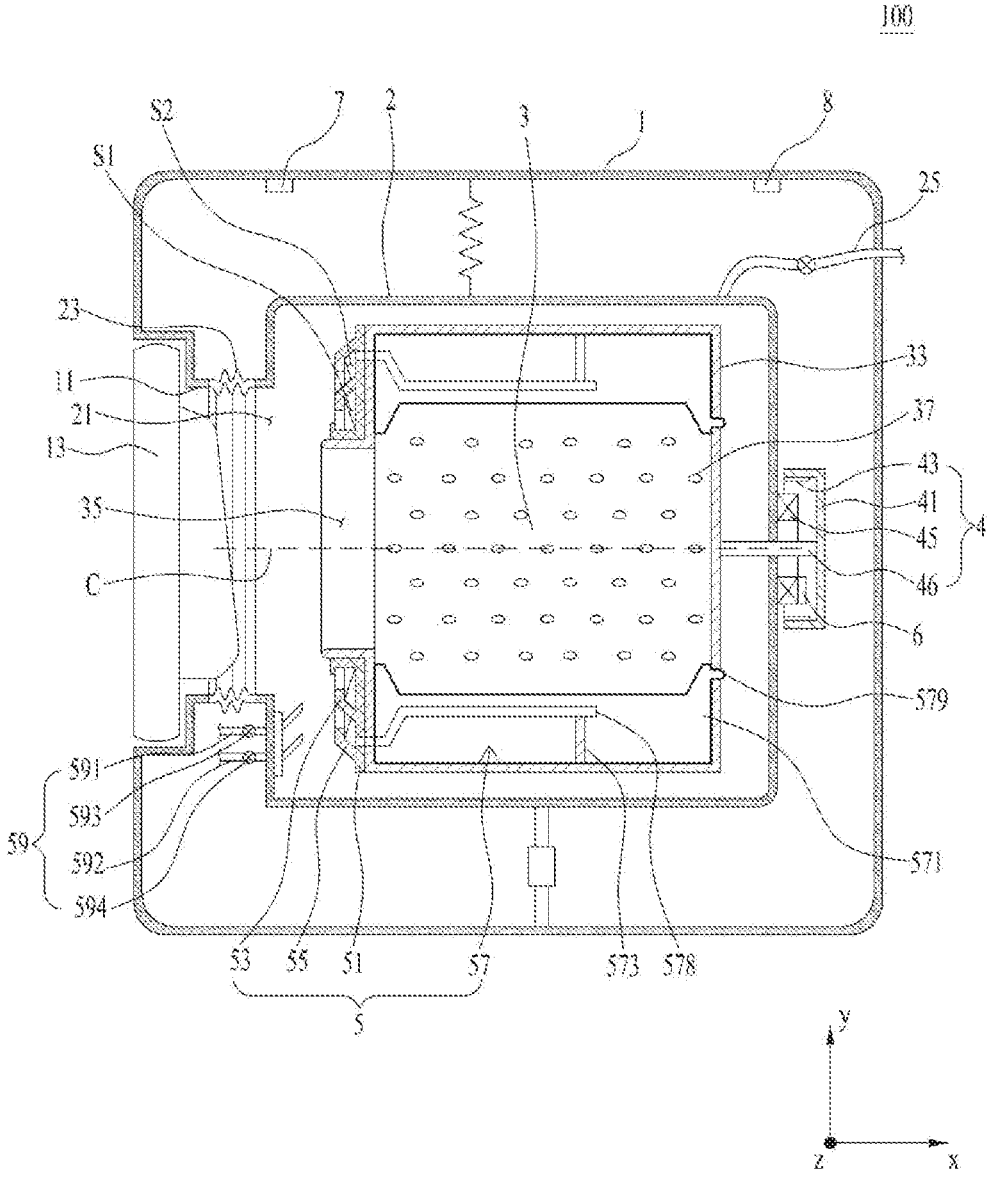
FIG. 1 illustrates one example of a laundry treating apparatus in accordance with the present invention.

As shown in FIG. 1, the laundry treating 100 in accordance with the present invention may include a cabinet 1; a tub 2 provided in the cabinet and holding wash water; a drum rotatably mounted in the tub and for storing laundry therein; a drive unit 4 for rotating the drum; and a balancing unit 5 controlling unbalance by temporarily increasing the weight of some portion located in opposite to a direction of the force generating the unbalance.

FIG. 1 illustrates the laundry treating apparatus 100 configured to wash clothes or laundry by using wash water. Accordingly, when one example of the laundry treating apparatus in accordance with the present invention is a laundry treating apparatus capable of washing and drying laundry, an air supply unit (not shown) for supplying air to the drum 3 has to be further provided in the cabinet 1.

Figure 2:
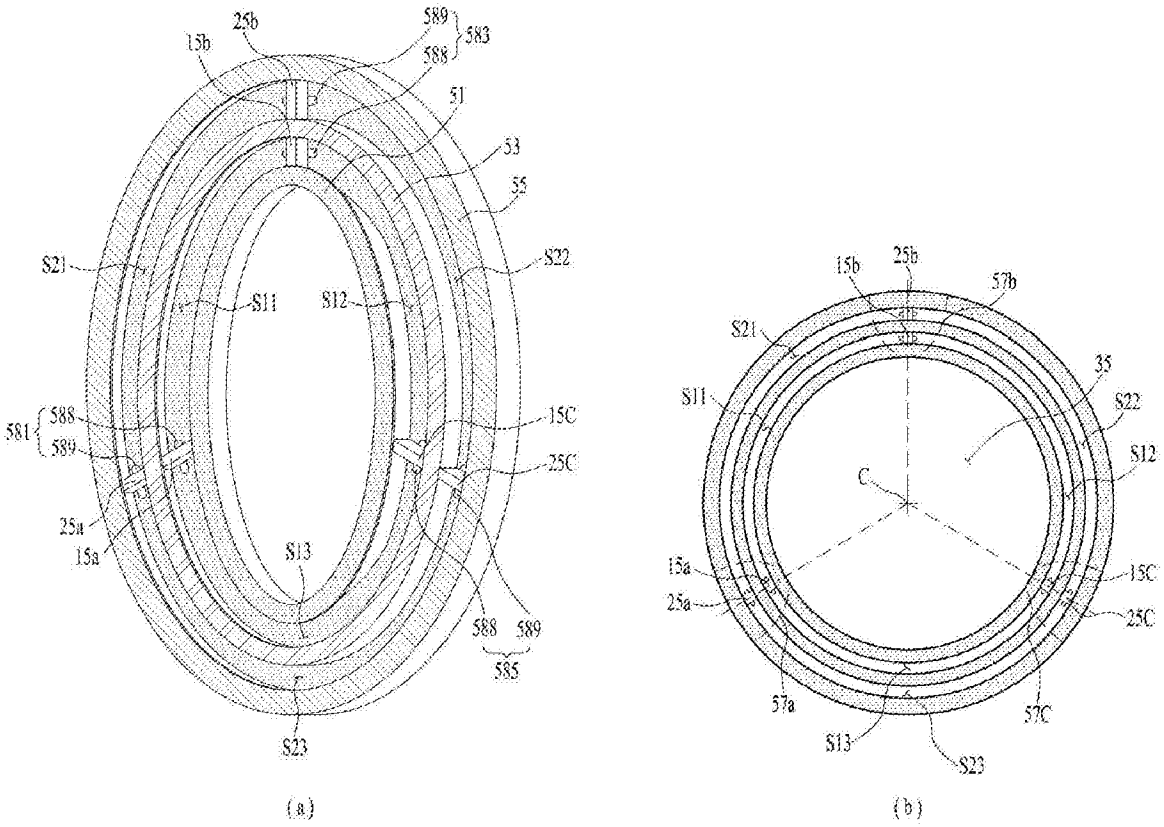
FIGS. 2 and 3 illustrate a balancing unit provided in the laundry treating apparatus.

Meanwhile, when one example of the laundry treating apparatus is a laundry treating apparatus only capable of drying clothes or laundry, the tub 2 shown in FIG. 2 may be omitted and the air supply unit (not shown) for supplying air to the drum 3 has to be provided.

Hereinafter, the example shown in FIG. 1 is applied to describe the present invention for simple explanation sake.

The cabinet 1 includes an opening 11 for loading laundry; and a door 13 rotatably provided in the cabinet and used in opening and closing the opening 11.

The tub may be provided in a hollow cylindrical shape and include a tub opening 21 which is in communicate with the opening 11.

A gasket 23 is provided between the tub opening 21 and the opening 11. The gasket 23 may function as means for preventing wash water from leaking outside and the vibration of the tub from being transferred to the cabinet.

The tub 2 is supplied wash water via a tub water supply unit 25 and the wash water held in the tub may be drained outside the cabinet via tub drainage unit (not shown).

The drum 3 has a hollow cylindrical drum body located in the tub 2.

A drum opening 35 in communication with the opening 11 and the tub opening 21 is provided in a front surface (31, or a front surface of the drum body) and a plurality of through holes 37 for allowing an internal space of the drum to communicate with an internal space of the tub are provided in a circumferential surface of the drum.

Accordingly, a user is able to load or unload laundry into or from the drum 3 through the opening 11. The wash water inside the tub 2 is able to flow toward the laundry loaded in the drum 3 and the wash water absorbed in the laundry is able to flow to the tub 2.

The drive unit 4 may be provided in diverse shapes only if capable of rotating the drum 3 within the tub 2. FIG. 1 shows a direct drive motor for driving the drum 3 as the drive unit and provided in a rear surface of the tub 2.

More specifically, the drive unit 4 may include a stator 45 fixed to the rear surface of the tub 2; a shaft 46 fixed to a rear surface 33 of the drum 3, penetrating the rear surface of the tub 2; a rotor 41 surrounding the stator, with the shaft 46 secured thereto; and a plurality of permanent magnets 43 for rotating the rotor 41, using a magnetic field formed by the stator 45.

The balancing unit 5 is the means for attenuating unbalance of the drum by temporarily increasing the weight of some region which is in symmetry with a region of the drum circumferential surface where the laundry causing the unbalance is located with respect to a rotation center of the drum.

The balancing unit 5 may include at least three balancers 57 fixed to the drum, spaced a preset distance from each other; a passage unit 51, 53 and 55 provided in at least one of the front and rear surfaces 31 and 33 of the drum to guide a liquid to each of the balancers 57; and a supply unit 59 provided in the tub 2 or the gasket 23 and supplying the liquid to the passage unit.

As shown in FIG. 2, the passage unit may include a first passage S1 formed by a first body 51 and a second body 53; and a second passage S2 formed by the second body 53 and a third body 55.

The first body 51 is formed in a shape bent toward a direction getting farther from the drum opening 35 after projected in a direction getting farther from the front surface 31 of the drum. The second body 53 is formed in a shape bent toward the drum opening 35 after projected from a surface of the first body 51 (in other words, extended in a direction getting farther from the front surface 31 of the drum).

The second body 53 is spaced a preset distance apart from the first body 51 so that the liquid injected by the supply unit 59 can be supplied to the first passage S1.

The third body 55 is formed in a shape bend toward the drum opening 35 after projected from a surface of the first body 51 (in other words, extended in a direction getting farther from the front surface 31 of the drum). The third body 55 is spaced a preset distance apart from the second body 53 so that the liquid injected by the supply unit 59 can be supplied to the second passage S2.

Meanwhile, the first passage S1 is partitioned off into a first space S11, a second space S12 and a third space S13 by three partition walls 15*a*, 15*b* and 15*c* provided therein. The second passage S2 is partitioned off into a first space S21, a second space S22 and a third space S23 by three partition walls 25*a*, 25*b* and 25*c* provided in the second passage.

The number of the balancers 57 may be variable only if spaced the same angle from each other in the drum circumferential surface. In FIG. 2 (*b*), three balancers 57*a*, 57*b* and 57*c* are spaced 120 degrees with respect to the rotation center (C) of the drum from each other as one example.

In other words, FIG. 2 (*b*) shows one example that the number of the balancers is equal to the number of the partition walls provided in the third passage S1 (or the number of the partition walls provided in the second passage S2).

The balancers 57 may be fixed to an outer circumferential surface of the drum or projected toward the rotation center (C) from an inner circumferential surface of the drum 3.

When provided in the inner circumferential surface of the drum, the balancers 57 may serve as means for agitating the laundry loaded in the drum during the rotation of the drum as well as the means for settling the unbalance.

Figure 3:
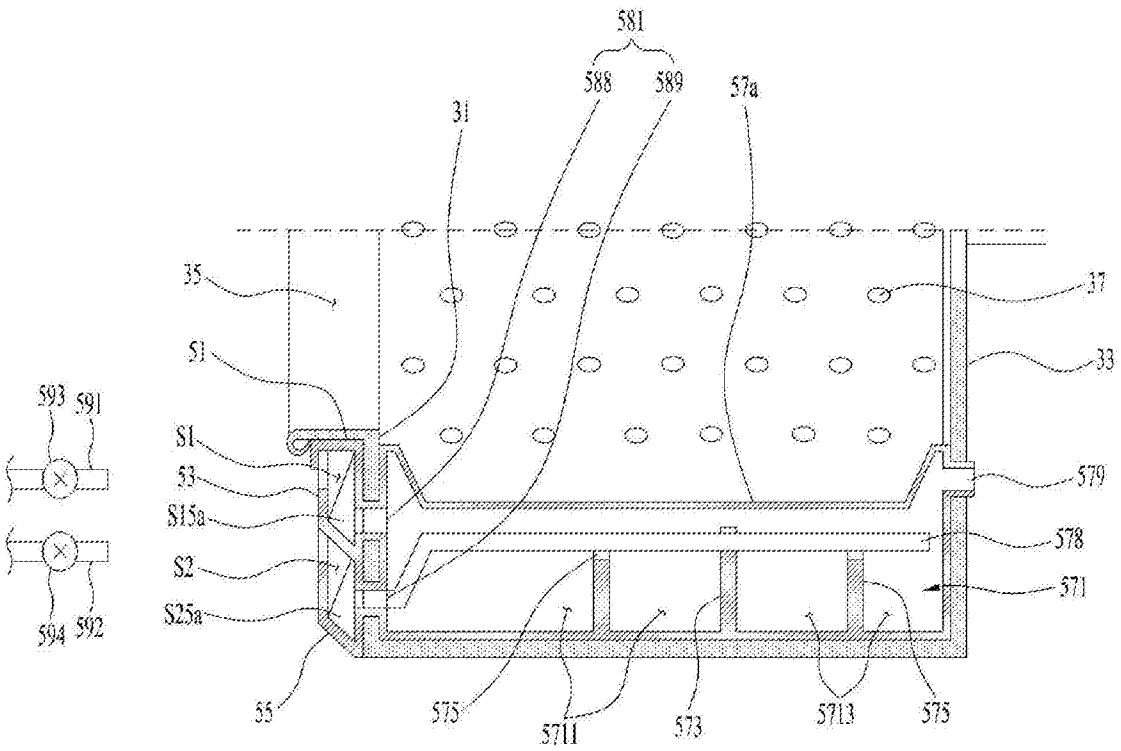

As shown in FIG. 3, each of the balancers 57 includes a storage portion 571 fixed to the inner circumferential surface of the drum and defining a predetermined space where the liquid is stored; and an exhaustion portion 579 for exhausting the liquid stored in the storage portion 571 outside the drum 3.

The storage portion 571 includes a front space 5711 and a rear space 5713 (a space located in the rear surface of the drum) which are partitioned off by a storage portion partition wall 573.

The storage portion partition wall 573 serves as means for completely separating the front space 5711 and the rear space 5713 from each other but means for allowing communication between the two spaces.

More specifically, the storage portion partition wall 573 may be extended toward a top surface from a bottom surface of the storage portion 571 to make a free end spaced a distance apart from the top surface.

Accordingly, when each of the balancers is located at the lowermost point of a drum rotation locus, the liquid stored in the front space 5711 keeps separated from the liquid stored in the rear space 5713. In contrast, when each of the balancers is located at the uppermost point of the drum rotation locus by the rotation of the drum, the liquid stored in the front and rear spaces 5711 and 5713 may flow toward the exhaustion portion 579.

The reason why the internal space of the storage portion 571 is divided into the front space 5711 and the rear space 5713 is to resolve the unbalance in the plane parallel with a diameter-direction cross section of the drum as well as a longitudinal direction cross section of the drum (in case laundry is concentrated on the rear surface or front surface of the drum), which will be described in detail later.

Moreover, internal spaces of the front and rear spaces 5711 and 5713 may be also partitioned off into plural spaces by a sub-partition wall.

The reason why each of the spaces defined in the storage portion is partitioned off into spaces by the sub-partition wall is to quickly resolve unbalance when laundry is concentrated only on the front or rear surface of the drum by filling the liquid the next spaces via a partition wall communication portion 575 after filling one of the spaces formed in the front or rear space 5711 or 5713.

Meanwhile, the storage portion 571 provided in each of the balancers 571 is connected to the first passage S1 and the second passage S2 via the communication portion. One example of the communication portion is shown in FIG. 2.

In other words, the storage portion 571 of the first balancer 57*a* is connected to the first passage S1 and the second passage S2 via a first communication portion 581. The storage portion 571 of the second balancer 57*b* is connected to the first passage S1 and the second passage S2 via a second communication portion 583. The storage portion of the third balancer 57*c* is connected to the first passage S1 and the second passage S2 via a third communication portion 585.

Each communication portion 581, 583 and 585 may include a front communication hole 588 and a rear communication hole 589. The front communication hole 588 may serve as means for supplying the liquid flowing in the first passage S1 to the front space 5711 provided in each of the balancers. The rear communication hole 589 may serve as means for supplying the liquid flowing in the second passage S2 to the rear space 5713 provided in each of the balancers.

In this instance, a guider (578, see FIG. 3) guiding the liquid flowing in the rear communication hole 589 to the rear space 5713 of each balancer has to be further provided in each balancer 57*a*, 57*b* and 57*c*.

Referring to FIG. 2, when the drum is rotated in a counter-clockwise direction, the liquid stored in the third space S13 of the first passage is supplied to the front space 5711 of the first balancer 57*a* by the first partition wall 15*a* of the first passage and the front communication hole 588 of the first communication portion 581 and the liquid stored in the first space Sll of the first passage is supplied to the front space of the second balancer 57*b* by the second partition wall 15*b* of the first passage and the front communication hole of the second communication portion 583 and the liquid stored in the second space S12 of the first passage is supplied to the front space of the third balancer 57*c* by the third partition wall 15*c* of the first passage and the front communication hole of the third communication portion 585.

Meanwhile, when the drum is rotated in the counter-clockwise direction, the liquid stored in the third space S23 of the second passage is supplied by the first partition wall 25*a* of the second passage and the rear communication hole 589 of the first communication portion 581 and the liquid stored in the first space S21 of the second passage is supplied to the rear space of the second balancer 57*b* by the second partition wall 25*b* of the second passage and the rear communication hole 589 of the second communication portion 583 and the liquid stored in the second space S22 of the second passage is supplied to the rear space of the third balancer 57*c* by the third partition wall 25*c* of the second passage and the rear communication hole 589 of the third communication portion 585.

As shown in FIG. 3, the supply portion 59 may include a first supply portion 591 for supplying the liquid to the first passage S1; and a second supply portion 92 for supplying the liquid to the second passage S2.

The first supply portion 591 and the second supply portion 592 may be provided in any region of the laundry treating apparatus capable of supplying the liquid to each passage S1 and S2. FIG. 1 shows one example that the first supply portion 591 and the second supply portion 592 are fixed to the tub 2.

In this instance, the first supply portion 591 and the second supply portion 592 may be connected to a water supply source located outside the cabinet 1. The first supply portion 591 may supply water to the first passage S1 via a first valve 593. The second supply portion 592 may supply water to the second passage S2 via a second valve 594.

The balancing unit 5 is described above under the assumption that the passage unit 51, 53 and 55 is provided in the front surface 31 of the drum. Alternatively, it is possible to supply the passage unit in the rear surface 33 of the drum. Moreover, the first passage S1 of the passage unit 51, 53 and 55 may be located in one of the front and rear surfaces of the drum and the second passage S2 may be located in the other one.

Meanwhile, the laundry treating apparatus 4 may further include a sensing unit for determining presence of unbalance and the location of the unbalance. As shown in FIG. 1, the sensing unit may include a first sensing unit 6 for sensing a magnetic force of a permanent magnet 43; a second sensing unit 7 for measuring front displacement of the tub 2; and a third sensing unit 8 for measuring rear displacement of the tub 2.

The first sensing unit 6 is means for sensing the magnetic force of the permanent magnet 43 provided in the rotor so as to sense a rotation speed, a rotation direction and a rotation angle of the rotor 41. A sensor configured to output a large electrical signal when a magnetic force is strong may be one example of the first sensing unit 6.

FIG. 1 shows one example that the first sensing unit 6 is fixed to the stator 45 to sense the magnetic force of the permanent magnet 43 (a sensor configured to output a large electrical signal as a distance between the first sensing unit and the permanent magnet 43 gets shorter may be one example of the first sensing unit).

The tub 2 may be fixedly mounted in the cabinet 1 by using dampening means such as a spring or a damper. The shaft 46 for rotating the drum 3 is fixed to the rear surface of the drum 3 through the rear surface of the tub, so that the vibration generated in the drum 3 can be transferred to the tub 2. Accordingly, the second sensing unit 7 and the third sensing unit 8 may be configured to measure how the front surface and the rear surface of the tub are vibrated, only to estimate the vibration of the front and rear surfaces of the drum.

The second sensing unit 7 may be configured to measure whether the front surface of the tub (the surface which is parallel with the front surface of the drum) is vibrated along a longitudinal direction (Y, see FIG. 1) of the cabinet or a traverse direction (Z) of the cabinet and the size of the vibration. The third sensing unit 8 may be configured to measure whether the rear surface of the tub (the surface which is parallel with the rear surface of the drum) is vibrated along a longitudinal direction (Y) or traverse direction (Z) of the cabinet and the size of the vibration.

The second sensing unit 7 may be a device configured to output a different electrical signal according to the distance with the front surface of the tub. The third sensing unit 8 may be a device configured to output a different electrical signal according to a distance with the rear surface of the tub.

The second sensing unit 7 may include a receiver provided in the front surface of the tub or the front surface of the tub and outputting electrical signals having different sizes according to the intensity of light; and a light emitter provided in the other of the two surfaces and emitting light toward the receiver.

In this instance, the receiver may output a large-sized electrical signal (such as a voltage) when the front surface of the tub becomes close to one surface of the cabinet where the receiver is located and a small-sized electrical signal when the front surface of the tub becomes far from the surface where the receiver is located.

The third sensing unit 8 may be provided in the same type with the second sensing unit 7 (for example, a receiver and a light emitter).

Figure 4:
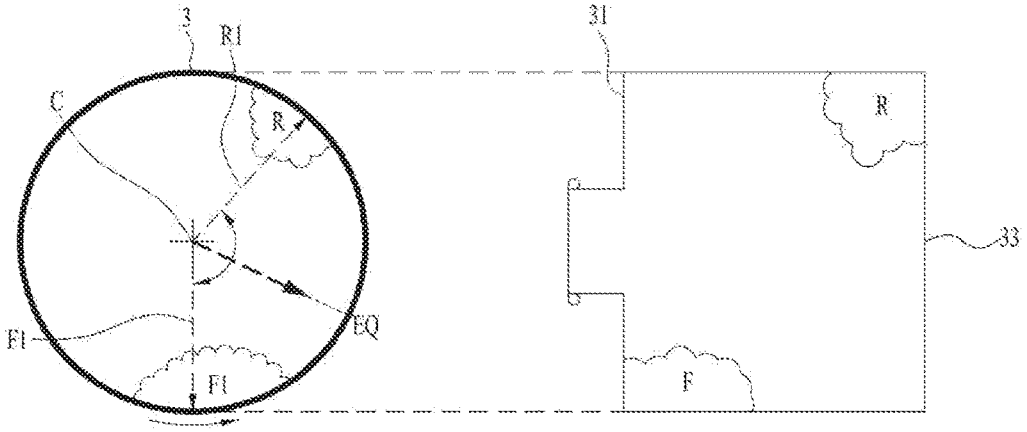
FIG. 4 illustrates one example that unbalance is generated in the drum by laundry.
Figure 4:
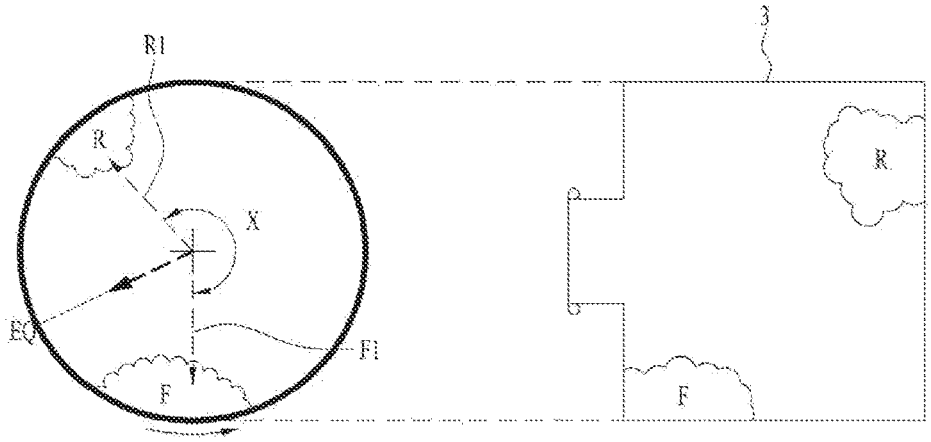

FIG. 4 shows that the unbalanced state is generated in the drum by the laundry stored in the drum 3. Left drawings of FIGS. 4 (*a*) and (*b*) illustrate a diameter-direction sectional view of the drum. Right drawings of FIGS. 4 (*a*) and (*b*) illustrate a longitudinal sectional view of the drum which is orthogonal to the bottom surface of the cabinet.

As shown in FIG. 4, the force (EQ) causing unbalance to the drum is a resultant force of a centrifugal force (F1) applied to the laundry (F) located in a front region of the drum and a centrifugal force (R1) applied to the laundry located in a rear region of the drum.

The location and size of the force (EQ) causing the unbalance may be determined based on a signal (RPM signal) provided by the first sensing unit 6.

Figure 5:
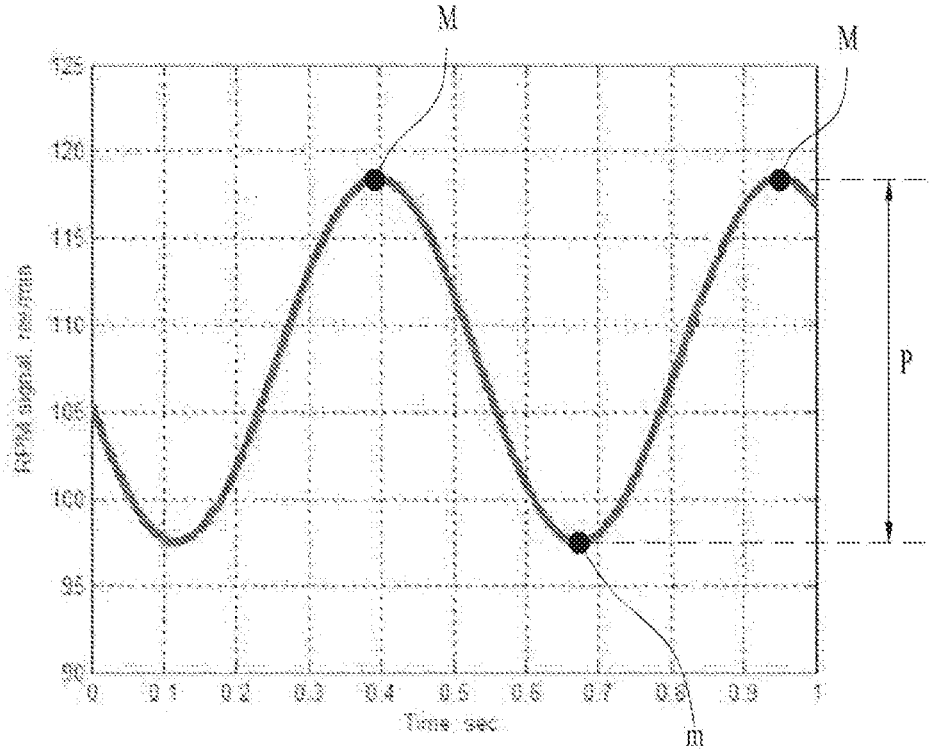
FIG. 5 illustrates one example of RPM data which is sensed by a first sensing unit provided in the laundry treating apparatus.

FIG. 5 shows one example of the drum RPM data measured by the first sensing unit 6 in which unbalance is generated.

When unbalance is generated in the drum, the rotation speed of the drum is the highest when the force (EQ) causing unbalance passes the lowermost point of the drum rotation locus and the lowest when the force (EQ) passes the uppermost of the drum rotation locus.

Accordingly, the point of time when the force (EQ) causing the unbalance passes the lowermost point of the drum rotation locus is the point of time when the drum RPM data measured by the first sensing unit 6 is the maximum (M).

Meanwhile, as the force (EQ) causing unbalance gets stronger, the amplitude (P) of the RPM data measured by the first sensing unit 6 gets increased more. In other words, the larger is the difference between the RPM maximum value (M) and the RPM minimum valve (m) measured by the first sensing unit 6, the stronger is the force (EQ) causing unbalance.

When the first sensing unit 6 is provided to transmit the drum RPM data to a control unit (not shown), the control unit is able to determine the location of the force (EQ) causing unbalance and the size of the force.

Meanwhile, in case a phase difference (X) between the centrifugal force (F1) applied to the laundry (F) located in the front region of the drum and the centrifugal force (R1) applied to the laundry (R) located in the rear region of the drum, there may be two examples shown in FIGS. 4 (*a*) and FIG. 4 (*b*).

FIG. 4 (*a*) shows that the centrifugal force (R1) applied to the rear region of the drum with respect to a drum rotation direction (for example, a counter-clockwise direction) precedes the force (EQ) causing unbalance. FIG. 4 (*b*) shows that the centrifugal force (F1) applied to the front region of the drum with respect to the drum rotation direction (the counter-clockwise direction) precedes the force (EQ) causing unbalance.

Figure 6:
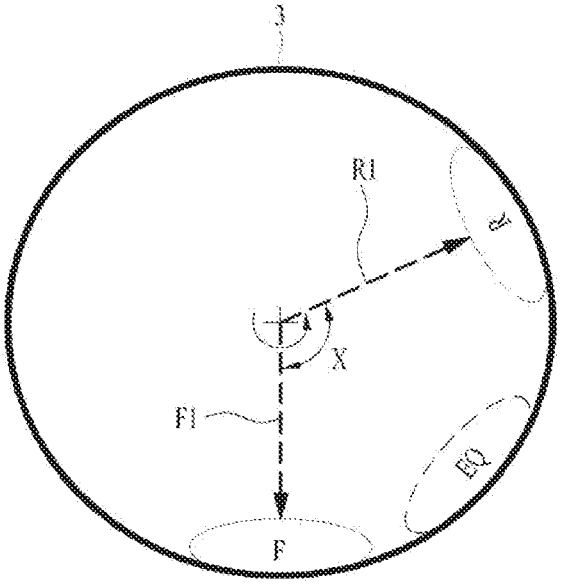
FIGS. 6 and 7 illustrates one example of the signals which are sensed by second and third sensing units provided in the laundry treating apparatus.
Figure 6:
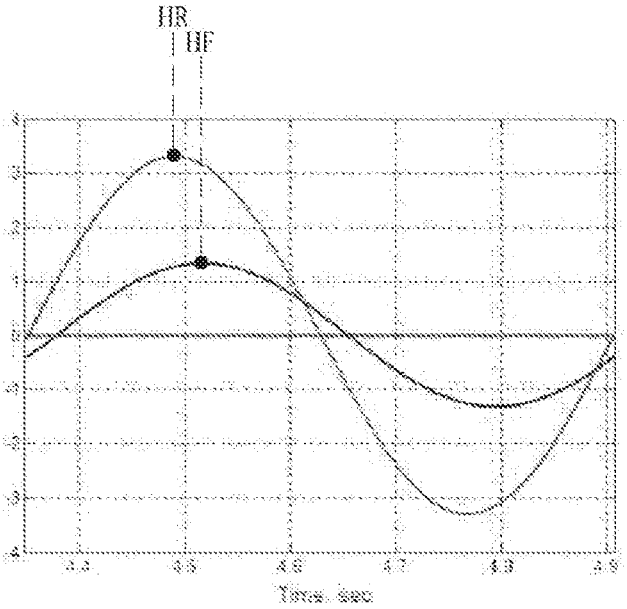

In case of FIG. 4 (*a*), a relation shown in FIG. 6 is generated between a signal sensed by the second sensing unit 7 and a signal sensed by the third sensing unit 8. In case of FIG. 4 (*b*), a relation shown in FIG. 7 is generated between the signal sensed by the second sensing unit 7 and the signal sensed by the third sensing unit 8.

As shown in FIG. 6, when the centrifugal force (R1) applied to the rear region of the drum with respect to the drum rotation direction precedes the force (EQ) causing unbalance, the maximum value (HR) of the electrical signal sensed by the third sensing unit 8 when the drum is rotated in the counter-clockwise direction is measured before the maximum value (HF) of the electrical signal measured by the second sensing unit 7.

Meanwhile, when the drum is rotated in a clockwise direction, the maximum (HF) of the electrical signal measured by the second sensing unit 7 is measured before the maximum value (HR) of the electrical signal measured by the third sensing unit 8.

Figure 7:
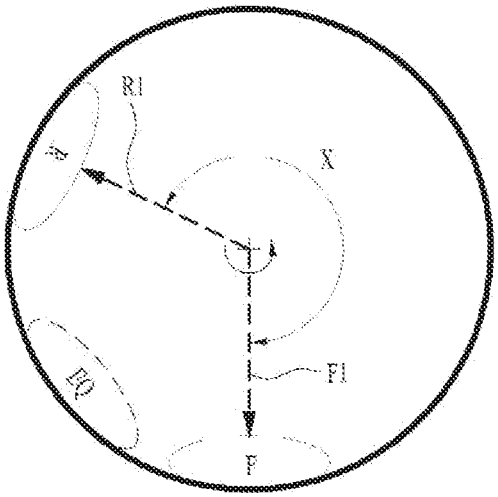
Figure 7:
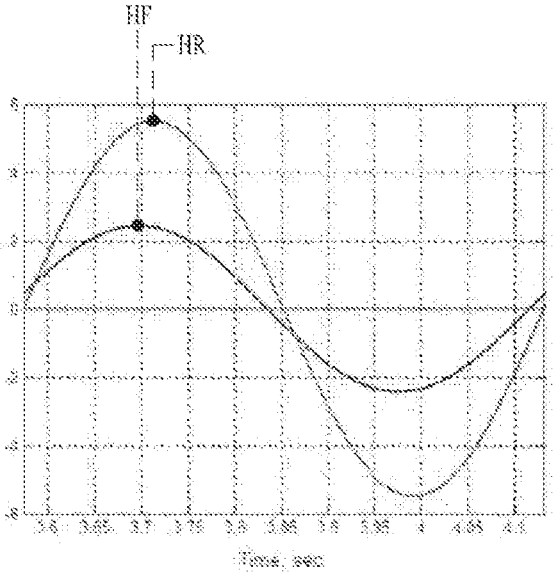

As shown in FIG. 7, when the centrifugal force (F1) applied to the front portion of the drum with respect to the drum rotation direction precedes the force (EQ) causing unbalance, the maximum value (HF) of the electrical signal measured by the second sensing unit 7 is measured before the maximum value (HR) of the electrical signal measured by the third sensing unit 8.

However, when the drum is rotated in the clockwise direction, the maximum value (HR) of the electrical signal measured by the third sensing unit 8 may be measured before the maximum value (HR) of the electrical signal measured by the second sensing unit 7.

The moving direction of the point where the resultant force of the centrifugal forces generated in the water supplied to the balancers is determined based on what is the force which precedes the force (EQ) causing unbalance with respect to the drum rotation direction, of which detailed description will be made later.

Figure 8:
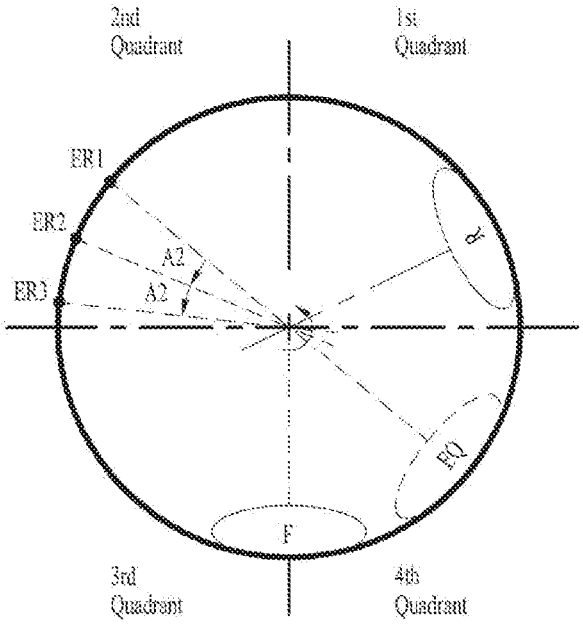
FIG. 8 illustrates a method for controlling the unbalance.
Figure 8:
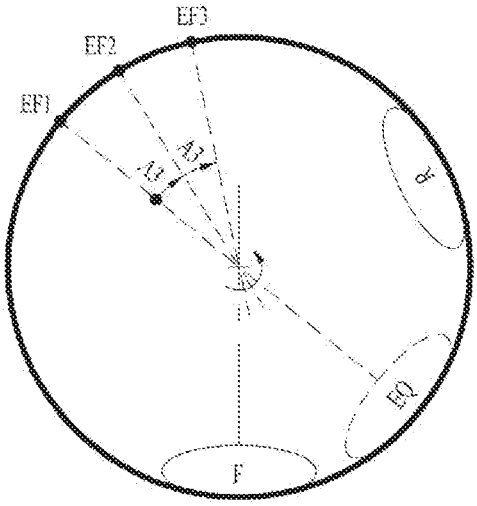

FIG. 8 is a schematic diagram of a method for controlling the unbalance of the drum which is in the same state as shown FIG. 6.

The control method for the laundry treating apparatus is characterized in that the centrifugal force (F1) applied to the laundry located in the front region of the drum is attenuated after the centrifugal force (R1) applied to the laundry located in the rear region of the drum is attenuated, based on the location of the force causing unbalance (the resultant force of the centrifugal forces (F1 and R1) applied to the front an drear regions of the drum).

The characteristic that the unbalance is controlled by attenuating the centrifugal force (F1) applied to the front region of the drum after attenuating the centrifugal force (R1) applied to the rear region of the drum is invented, because a level of contribution of the centrifugal force (R1) applied to the rear region of the drum to the unbalance of the drum is higher than a level of contribution of the centrifugal force (F1) applied to the front region of the drum.

That is confirmed experimentally. It is estimated to be caused by a combination of the presence of the gasket 23 connecting the tub opening 21 of the tub front and the cabinet opening 11 with each other and the presence of the drum shaft 46 penetrating the rear surface of the tub.

Meanwhile, it is much easier to determine the location of the force (EQ) causing unbalance than to determine a point to the centrifugal force (R1) or the centrifugal force (F1) is applied in the drum circumferential surface. Accordingly, to attenuate the centrifugal force (R1) applied to the rear region of the drum and the centrifugal force (F1) applied to the front region of the drum based on the location of the force (EQ) causing unbalance is easier than to attenuate the centrifugal forces (R1 and F1) by determining the point of the drum circumferential surface where the centrifugal force (R1 or F1) is applied.

More specifically, the signal output by the second sensing unit 7 or the third sensing unit 8 is configured to measure the vibration of the tub front surface or the tub rear surface generated by the force causing unbalance. It is difficult to determine the point of time when the maximum value is output by the second sensing unit 7 or the third sensing unit 8 as the point where Fland R1 is applied.

However, the point where the force (EQ) causing unbalance is applied is the point where the laundry passes the lowermost point of the drum rotation locus when the maximum value of the signal output by the first sensing unit 6, so that it is easier to determine the point where the force (EQ) causing unbalance is applied than to determine the point where FI or R1 is applied.

When the control method for the laundry treating apparatus is described in detail, referring to FIG. 8, the control method includes a rear region controlling step (see FIG. 8 (*a*)) and a front region controlling step (see FIG. 8 (*b*)).

The rear region controlling step is configured to minimize the amplitude of drum vibration by increasing the weight of a quadrant (a first target quadrant) located in opposite to a quadrant to which the force (EQ) causing unbalance is directed in the drum circumferential surface after supplying a liquid to one or more of the rear spaces 5713 provided in each of the balancers.

FIG. 8 (*a*) shows one example that the force (EQ) causing unbalance is located in a fourth quadrant. In this instance, the first target quadrant is a second quadrant.

The rear region controlling step may be divided into a first rear controlling step and a second rear region controlling step.

The first rear controlling step is configured to supply the liquid to some of the rear spaces so as to increase the weights of two or more different points ER1, ER2 and ER3 in the drum circumferential surface located in the first target quadrant.

In this instance, the second rear controlling step is configured to additionally supplying the liquid to some of the rear spaces so as to increase the weight of one of the two or more points ER1, ER2 or ER3, with the smallest unbalance.

Meanwhile, the first rear controlling step may include a first rear supply step and a second rear supply step.

The first rear supply step is configured to supply the liquid to some of the rear spaces to increase the weight of a random a first rear point ER1 in the drum circumferential surface located in the first target quadrant.

The second rear supply step is configured to supply the liquid to some of the rear spaces to increase the weight of a second rear point ER2 spaced a preset first angle A2 from the first rear point ER1.

Figure 9:
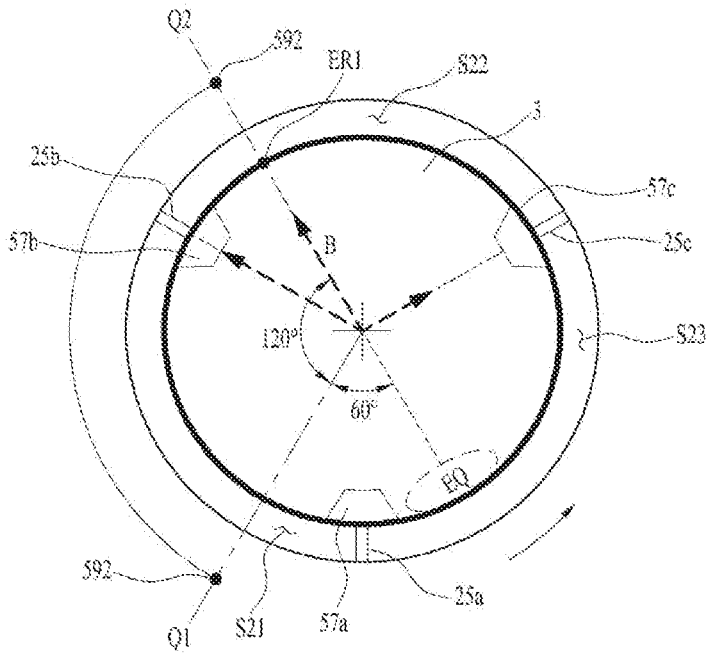
FIG. 9 illustrates one example of a rear portion control step.
Figure 9:
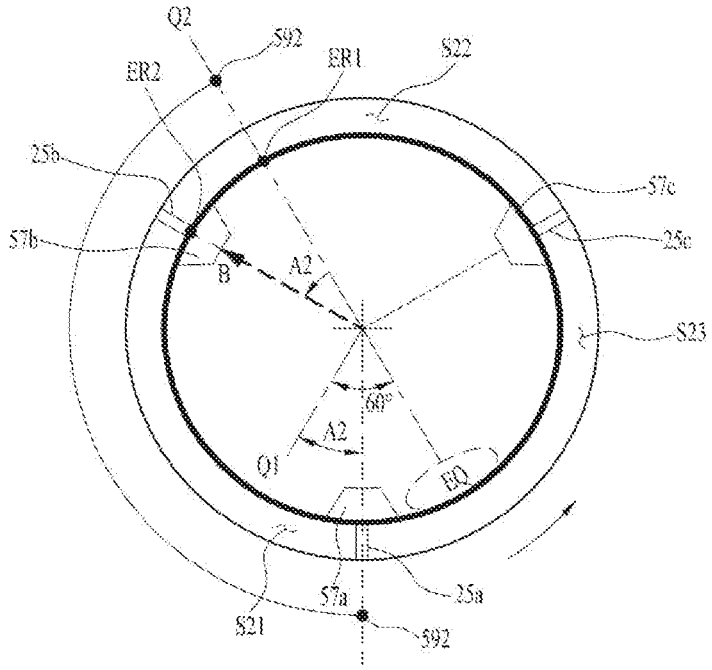

As shown in FIG. 9 (*a*), the first rear supply step is the step for supplying the liquid to some of the rear spaces 5713 provided in each balancer so as to increase the weight of the point ER1 in the rear drum circumferential surface spaced 180 degrees from the point where the force (EQ) causing unbalance is directed (a case where a second injecting unit injects water while the drum is rotated is equal to a case where a second injecting unit is rotated while the drum is fixed, which is shown in FIG. 9).

More specifically, in the first rear supply step, the lowermost point of the drum rotation locus is rotated to a preset standby angle (Q1, in other words, a first reference angle) after the first sensing unit 6 senses the maximum RPM value of the drum) and the second supply unit 592 supplies the liquid to the second passage S2 while the drum is rotated to a preset end angle (Q2, in other words, a second reference angle) from the ending time of the standby angle. In this instance, an angle at which the second supply unit 592 injects the liquid to the second passage S2 is the value gained by subtracting the standby angle from the end angle.

As shown in FIG. 9 (*a*), the three balancers 57 provided in the drum are distant 120 degrees from each other and the second passage S2 having the three spaces S21, S22 and S23 is provided in the drum, the standby angle Q1 may be 60 degrees and the supply angle (Q2–Q1) may be 120 degrees as one example.

As mentioned above, the liquid injected to a first space S21 of the second passage may be supplied only to the rear space of the second balancer 57*b*. The liquid injected to the second space S22 of the second passage may be supplied only to the rear space of the third balancer 57*c*.

When the second supply unit 592 injects the liquid to the second passage S2 while the drum is rotated from the ending time (Q1) of the standby angle to the ending time (Q2) of the end angle, the direction of the resultant force of the centrifugal force applied to the liquid stored in the second balancer 57*b* and the centrifugal force applied to the liquid stored in the third balancer 57*c* is almost identical to the direction of the force (EQ) causing unbalance.

Accordingly, the force (EQ) causing unbalance may be attenuated by the resultant force of the centrifugal force applied to the liquid supplied to the rear space of the second balancer 57*b* and the centrifugal force applied to the liquid supplied to the rear space of the third balancer 57*c*, so that the amplitude of the drum vibration measured by the first sensing unit 6 can be decreased (the size of the unbalance may be reduced).

If it is difficult to precisely determine the point to which the force (EQ) causing unbalance is directed and the point ER1 located in opposite in the rear circumferential surface of the drum, the first rear supply step may be configured to supply the liquid to one or more of the rear spaces 5713 provided in each balancer so as to increase the weight of one random point located in the first target quadrant in the drum circumferential surface.

Once the first rear supply step for increasing the weight of the first rear point ER1 shown in FIG. 9 (*a*) is complete, the second rear supply step shown in FIG. 9 (*b*) starts.

The second rear supply step is configured to supply the liquid so as to increase the weight of the rear second point ER2 spaced the preset first angle (A2) from the first rear point ER1.

The location of the second rear point ER2 is determined when the centrifugal force (F1) applied to the front region of the drum or the centrifugal force (R1) applied to the rear region of the drum is measured before the force (EQ) causing unbalance.

More specifically, as shown in FIG. 8 (*a*), when the centrifugal force (R1) applied to the rear region of the drum with respect to the drum rotation direction before the force (EQ) causing unbalance, the second rear point ER2 may be a point which is distant from the first rear point ER1 as far as the preset first angle (A2).

However, when the centrifugal force (F1) applied to the front region of the drum with respect to the drum rotation direction is measured before the force (EQ) causing unbalance, the second rear point ER2 may be a point which is distant from the first rear point ER1 as far as the first angle (A2) in the opposite direction to the drum rotation direction.

The ultimate goal of the first rear controlling step is to minimize the centrifugal force (R1) applied to the laundry located in the rear region of the drum by performing the rear supply step two or more times.

Accordingly, in case the centrifugal force (R1) applied to the rear region of the drum with respect to the drum rotation direction (the counter-clockwise direction) precedes the force (EQ) causing unbalance (in case of FIG. 9 (*a*)), a point which is distant from the first rear point ER1 as far as the first angle along the same direction with the drum rotation direction may be set as the second rear point ER2.

In FIG. 9 (*a*), when the point distant the first angle A2 from the first rear point ER1 from the first rear point ER1 in an opposite direction to the drum rotation direction(a clockwise direction) is set as the second rear point ER2, the centrifugal force applied to the liquid stored in the rear spaces of the balancers is directed not toward the opposite direction to the centrifugal force (R1) applied to the laundry located in the rear portion of the drum but toward the centrifugal force (R1). That is likely to increase unbalance.

It may be determined according to which one of the maximum values of the electrical signals is early measured by the second sensing unit 7 or the third sensing unit 8 which one of the centrifugal forces (F1) applied to the front region and the rear region of the drum with respect to the drum rotation direction is measured before the force (EQ) causing unbalance, which is described before.

When the maximum value (HR) of the third sensing unit 8 is before the maximum valve (HR) measured by the second sensing unit 7 while the drum is rotated in the counter-clockwise direction, it can be determined that the centrifugal force (R1) applied to the rear region of the drum precedes the force (EQ) causing unbalance (FIG. 6). When the maximum value (HR) sensed by the second sensing unit 7 is before the maximum value (HR) measured by the third sensing unit 8, it can be determined that the centrifugal force (F1) applied to the front region of the drum precedes the force (EQ) causing unbalance (FIG. 7).

Accordingly, the second rear supply step is the step for injecting the liquid to the second passage S2 until the drum is rotated from an end point (Q1−A2) of the drum standby angle to the end angle (Q20A2), once the lowermost point of the drum rotation locus reaches the drum standby point (Q10A2) after the first sensing unit 6 senses the drum RPM maximum value. Even in this instance, the angle at which the second supply unit 592 supplies the liquid to the second passage S2 is 120 degrees.

Once the first rear supply step and the second rear supply step are complete, the control method starts the second rear controlling step. The second rear controlling step is configured to additionally supply the liquid to some of the rear spaces of the balancers so as to increase the weights of the rear portion ER1 and ER2 having smaller unbalance out of the size of the unbalance measured after the first rear supply step and the size of the unbalance measured after the second rear supply step.

More specifically, when the unbalance measured after the second rear supply step is larger than the unbalance measured after the first rear supply step, the second rear supply step additionally supplies the liquid to some of the rear spaces of each balancer so as to increase the weight of the first rear point ER1 in the drum circumferential surface (see FIG. 9 (*a*)).

However, when the unbalance measured after the second rear supply step is smaller than the unbalance measured after the first rear supply step, the control method of the laundry treating apparatus starts a third rear supply step and the rear controlling method again.

As shown in FIG. 8 (*a*), the third rear supply step supplies the liquid to some of the rear spaces so as to increase the weight of a third rear point ER3 which is distant from the second rear point ER2 as far as the first angle (A2).

In other words, when the lowermost point of the drum is rotated until the drum standby angle (Q1−(A2+A2)) after the first sensing unit 6 senses the maximum drum RPM value, the third rear supply step may be configured to inject the liquid to the second passage S2 while the drum is rotated from the end point to the end angle (Q2−A2+A2)) of the drum standby angle to an end angle (Q2−(A2+A2)). Even in this instance, the angle at which the second supply unit 592 injects the liquid to the second passage S2 may be 120 degrees.

When the first rear controlling step includes first rear supply step, the second rear supply step and the third rear supply step, the second rear controlling step supplies the liquid to some of the rear regions Er1, Er2 and ER3 with the smaller unbalance.

As mentioned above, the size of the unbalance may be determined based on the amplitude of drum RPM vibration measured by the first sensing unit 6.

Once the rear controlling step (the step for attenuating the centrifugal force located in the rear region of the drum) is completed as mentioned above, the control method of the laundry treating apparatus may start a front controlling step shown in FIG. 8 (*b*) for attenuating the centrifugal force located in the front region of the drum.

As shown in FIG. 8 (*b*), the front controlling step is configured to increase the weight of one quadrant (a second target quadrant) that is located opposite to a quadrant to which the force causing unbalance is directed in the drum circumferential surface.

The second target quadrant of the front controlling step may be equal to the first target quadrant of the first rear controlling step or another quadrant different from the first target quadrant in the rear controlling step.

Once the rear controlling step is complete, the point of the drum circumferential surface the force (EQ) causing unbalance is applied to may be changed, so that the second target quadrant can be set another quadrant different from the first target quadrant of the rear controlling step.

In this instance, the second target quadrant has to be a region distant 180 degrees from the drum region where the drum RPM maximum value is measured. The control unit (not shown) determines the region where the drum RPM maxim value is measured based on the signal transmitted by the first sensing unit 6.

When the front controlling step is performed by setting the second target quadrant different from the first target quadrant, it takes more time to control unbalance. To control unbalance rapidly, the second target quadrant may be set equal to the first target quadrant.

The front controlling step may include a first front controlling step and a second front controlling step.

As shown in FIG. 8 (*b*), the first front controlling step is configured to supply the liquid to some of the front spaces 5711 provided in each balancer so as to increase the weights of two or more different points EF1, EF2 and EF3 in the drum circumferential surface located in the second target quadrant.

In this instance, the second front controlling step additionally supplies the liquid to some of the front spaces 5711 provided in each balancer so as to increase the weight of the point with a smallest unbalance out of the two or more different points EF1, EF2 and EF3.

The first front controlling step may include a first front supply step and a second front supply step.

The first front supply step is configured to supply the liquid to some of the rear spaces provided in each balancer so as to increase the weight of one random first front point EF1 in the drum circumferential surface located in the second target quadrant.

The second front supply step is configured to supply the liquid to some of the rear spaces provided in each balancer so as to increase the weight of a second front point EF2 which is distant a preset second angle A3 from the first front point EF1.

Figure 10:
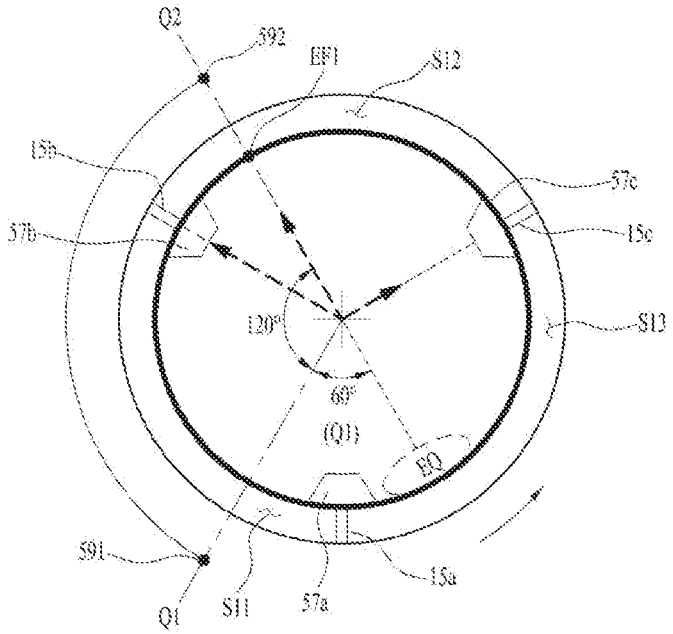
FIG. 10 illustrates one example of a front portion control step.
Figure 10:
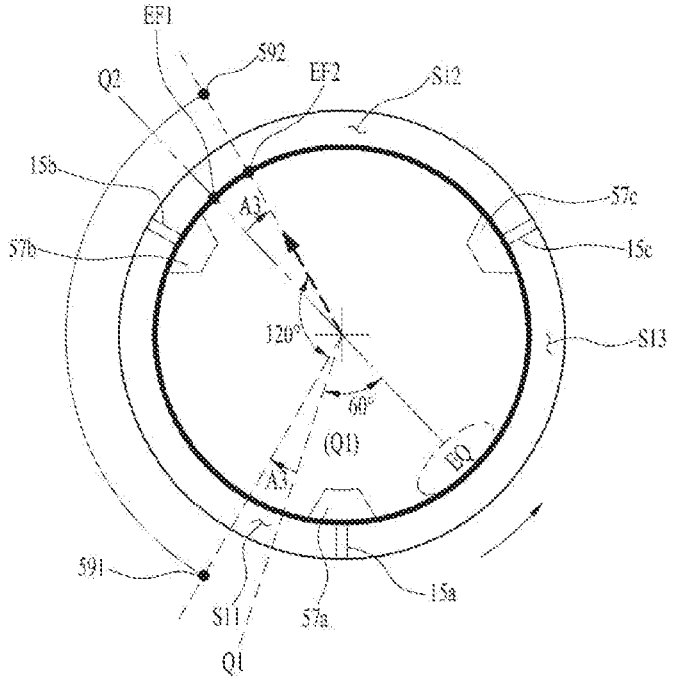

As shown in FIG. 10 (*a*), the first front supply step supplies the liquid to some of the front spaces 5711 provided in each balancer so as to increase the weight of one point EF1 distant 180 degrees from the point the force (EQ) causing unbalance is directed to in the drum front circumferential surface.

More specifically, in the first front supply step, the first sensing unit 6 senses the drum RPM maximum value and the lowermost point of the drum rotation locus is rotated until a preset standby angle Q1, only for the first supply unit 591 to supply the liquid to the first passage S1 while the drum is rotated from an end point (Q1) of the drum standby angle to a preset end angle (Q2) (the drum is fixed in a state where the first injection unit injects water while the drum is rotated and the state is equal to a state where the drum is fixed while a first injection unit is rotated, which is shown in FIG. 10).

When three balancers 57 are distant 120 degrees from each other, with the first passage S1 provided in the drum, with three spaces S11, S12 and S13, the drum standby angle may be 60 degrees with respect to the point the force (EQ) causing unbalance is directed to and the end angle may be 180 degrees with respect to the point the force (EQ0) is directed to and a supply angle (Q2−Q1) of the liquid injected by the first injection unit may be 120 degrees as one example.

If it is difficult to determine the point the force (EQ) causing unbalance in the drum front circumferential surface and the point EF1 located in opposite to the point, the first front supply step is capable of supplying the liquid to one or more front spaces 5711 provided in each balancer so as to increase the weight of one random point located in the second target quadrant in the drum circumferential surface.

Once the first front supply step for increasing the weight of the first front point EF1 is complete, a second front supply step shown in FIG. 10 (*b*) starts.

The second front supply step is configured to supply the liquid so as to increase the weight of a second front point EF2 which is distant a preset second angle (A3) from the first front point EF1. The second angle A3 may be set to be equal to the first angle A2 set in the second rear supply step or different from the first angle A2.

The location of the second front point EF2 may be determined based on which centrifugal force R1 or F1 applied to the front or rear region of the drum with respect to the drum rotation direction is measured before the force (EQ) causing unbalance.

As shown in FIG. 8 (*b*), when the centrifugal force (R1) applied to the rear region of the drum with respect to the drum rotation direction is measured before the force (EQ) causing unbalance, a point which is distant the second angle A3 from the first front point EF1 in an opposite direction to the drum rotation direction has to be set as the second front point EF2.

However, when the centrifugal force (F1) applied to the front region of the drum with respect to the drum rotation direction is measured before the force (EQ) causing unbalance, a point which is distant the second angle A3 from the first point EF1 in the drum rotation direction has to be set as the second front point EF2.

The ultimate goal of the first front controlling step is also to minimize the centrifugal force (F1) applied to the laundry located in the rear region of the drum. Accordingly, a point distant the second angle A3 from the first front point EF1 along the opposite direction of the drum rotation direction is set as the second front point EF2.

The second front supply step is configured for the first supply unit 591 to inject the liquid to the first passage S1 while the drum is rotated from an end point (Q1+A3) of the drum standby angle to an end angle (Q2+A3), once the lowermost point of the drum is rotated to the standby angle (Q1+A3) after the first sensing unit 6 senses the maximum value of the drum RPM. Even in this instance, the angle at which the first supply unit 591 injects the liquid to the first passage S1 is 120 degrees.

After the first front supply step and the second front supply step, the control method starts a second front controlling step. The second front controlling step is configured to additionally supply a liquid to some of the front spaces provided in each balancer so as to increase the weight of the front point EF1 and EF2 with smaller one of the unbalance measured after the first front supply step and the unbalance measured after the second front supply step.

More specifically, when the unbalance measured after the second front supply step is larger than the unbalance measured after the first front supply step, the second front supply step additionally supplies a liquid to some of the front spaces provided in each balancer to as to increase the weight of the first front point EF1 in the drum circumferential surface.

However, when the unbalance measured after the second front supply step is smaller than the unbalance measured after the first front supply step, the controlling method performs a third front supply step and then the second front controlling step.

As shown in FIG. 8 (*b*), the third front supply step supplies the liquid to some of the front spaces provided in each balancer to as to increase the weigh of a third front point EF3 which is distant the second angle A3 from the second front point EF2.

More specifically, when the lowermost point of the drum is rotated to the standby angle (Q1+(A3+A3)) after the first sensing unit 6 senses the maximum of the drum RPM, the third front supply step controls the first supply unit 591 to supply a liquid to the first passage S1 while the drum is rotated from an end point (Q1+(A3+A3)) to an end angle (Q2+(A3+A3)) of the drum standby angle.

When the first front controlling step includes the first front supply step, the second front supply step and the third front supply step, the second front supply step additionally supplies the liquid to some of the front spaces provided in each balancer so as to increase the weight of one having the smallest unbalance out of the three points EF1, EF2 and EF3.

In the second front controlling step, the size of the unbalance may be also determined based on the amplitude of the drum RPM (P) measured by the first sensing unit 6.

Meanwhile, when the drum is divided into two regions with respect to a straight line passing the rotation center of the drum, the rear controlling step may be configured to supply a liquid to at least one of the rear spaces 5713 provided in each balancer so as to increase the weight of the opposite point in the drum circumferential surface to a point the force (EQ) causing unbalance is directed and to minimize the amplitude of the drum vibration.

The front controlling step may be configured to supply a liquid to at least one of the rear spaces 5713 provided in each balancer so as to increase the weight of the opposite point in the drum circumferential surface to a point the force (EQ) causing unbalance is directed and to minimize the amplitude of the drum vibration.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds, are therefore intended to be embraced by the appended claims.

What is claimed is:

1. A control method for a laundry treating apparatus comprising a drum in which laundry is loaded; a shaft fixed to a rear surface of the drum to rotate the drum; three or more balancers fixed to the drum and spaced the same angle from each other with respect to a rotation center of the drum; a front space provided in each of the balancers and located in a front region of the drum; a rear space provided in each of the balancers and located in a rear region of the drum; and a sensor configured to sense unbalance and a location of laundry causing the unbalance, the method comprising:

supplying a liquid a first time to the rear space of one or more of the balancers so as to increase the weight at a first target quadrant that is located opposite to a quadrant to which a force causing unbalance is directed on a drum circumferential surface; and supplying the liquid a first time to the front space of one or more of the balancers so as to increase the weight at a second target quadrant that is located opposite to which the force causing unbalance is directed on the drum circumferential surface, wherein the liquid is supplied the first time to the front space of the one or more of the balancers after the supplying of the liquid the first time to the rear space of the one or more of the balancers is completed.

2. The control method for the laundry treating apparatus of claim 1, wherein the supplying of the liquid the first time to the rear space comprises:

supplying the liquid a second time to some of the rear spaces so as to increase the weights of two or more different points on the drum circumferential surface located in the first target quadrant; and supplying the liquid a third time to some of the rear spaces so as to increase the weight of one point capable of minimizing the size of unbalance out of the two or more different points.

3. The control method for the laundry treating apparatus of claim 2, wherein a size of an unbalance based on the amplitude of an RPM of the drum is measured during the supplying of the liquid the third time.

4. The control method for the laundry treating apparatus of claim 2, wherein the supplying of the liquid the second time comprises:

supplying the liquid a fourth time to some of the rear spaces so as to increase the weight of a first rear point of the two or more different points in the drum circumferential surface located in the first target quadrant; and supplying the liquid a fifth time to some of the rear spaces so as to increase the weight of a second rear point of the two or more different points that is spaced a preset first angle from the first rear point.

5. The control method for the laundry treating apparatus of claim 4, wherein when the sensor senses a centrifugal force applied to laundry located in the rear region of the drum with respect to a drum rotation direction prior to the force causing unbalance, a point spaced from the first rear point by the first angle in the same direction as the drum rotation direction as the second rear point is set during the supplying of the liquid the fifth time.

6. The control method for the laundry treating apparatus of claim 4, wherein when the sensor senses a centrifugal force applied to laundry located in the front region of the drum with respect to a drum rotation direction prior to the force causing unbalance, a point spaced from the first rear point by the first angle in an opposite direction as the drum rotation direction as the second rear point is set during the supplying of the liquid the fifth time.

7. The control method for the laundry treating apparatus of claim 4, wherein when an unbalance measured after the supplying of the liquid the fifth time is smaller than an unbalance measured after the supplying of the liquid the fourth time, the method further comprises:

supplying a liquid a sixth time to some of the rear spaces so as to increase the weight of a third rear point spaced from the second rear point by the first angle.

8. The control method for the laundry treating apparatus of claim 1, wherein the supplying of the liquid the first time to the front space comprises:

supplying the liquid a second time to some of the front spaces so as to increase the weights of two or more different points on the drum circumferential surface located in the second target quadrant; and supplying the liquid a third time to some of the front spaces so as to increase the weight of one point capable of minimizing the size of unbalance out of the two or more different points.

9. The control method for the laundry treating apparatus of claim 8, wherein the supplying of the liquid the second time comprises:

supplying the liquid a fourth time to some of the front spaces so as to increase the weight of a first front point of the two or more points on the drum circumferential surface located in the second target quadrant; and supplying the liquid a fifth time to some of the front spaces so as to increase the weight of a second front point of the two or more points that is spaced a preset first angle from the first front point.

10. The control method for the laundry treating apparatus of claim 9, wherein when the sensor senses a centrifugal force applied to laundry located in the front region of the drum with respect to a drum rotation direction prior to the force causing unbalance, a point spaced from the first front point by the preset first angle in an opposite direction as the drum rotation direction as the second front point is set during the supplying of the liquid the fifth time.

11. The control method for the laundry treating apparatus of claim 9, wherein when the sensor senses a centrifugal force applied to laundry located in the front region of the drum with respect to a drum rotation direction prior to the force causing unbalance, a point spaced from the first front point by the preset first angle from the first front point in the same direction as the drum rotation direction as the second front point is set during the supplying of the liquid the fifth time.

12. The control method for the laundry treating apparatus of claim 8, wherein a size of the unbalance based on the amplitude of an RPM of the drum is measured during the supplying of the liquid the third time.

13. The control method for the laundry treating apparatus of claim 8, wherein the second target quadrant is set after the supplying of the liquid the first time to the rear space of one or more of the balancers is completed.

14. The control method for the laundry treating apparatus of claim 8, wherein the first target quadrant is the same as the second target quadrant.

15. The control method for the laundry treating apparatus of claim 1, wherein the laundry treating apparatus further comprises:

a first passage comprising spaces partitioned off to correspond to each of the balancers, the spaces of the first passage being in communication with the front space of each balancer, respectively;

a second passage comprising spaces partitioned off to correspond to each of the balancers, the spaces of the second passage being in communication with the rear space of each balancer, respectively;

a first supply unit configured to supply a liquid to the first passage; and a second supply unit configured to supply a liquid to the second passage, wherein when a bottom dead center of the drum is rotated to a preset first reference angle after the maximum value of an RPM of the drum is measured, the second supply unit is configured to supply the liquid to the second passage while the drum is rotated from the preset first reference angle to a preset second reference angle that is greater than the preset first reference angle, and wherein when the bottom dead center of the drum is rotated to the preset first reference angle after the maximum value of the RPM of the drum is measured, the first supply unit is configured to supply the liquid to the first passage while the drum is rotated to the preset second reference angle from the preset first reference angle.

16. A control method for a laundry treating apparatus comprising a drum in which laundry is loaded; a shaft fixed to a rear surface of the drum to rotate the drum; three or more balancers fixed to the drum and spaced the same angle from each other with respect to a rotation center of the drum; a front space provided in each of the balancers and located in a front region of the drum; a rear space provided in each of the balancers and located in a rear region of the drum; a first passage provided in a circumferential direction on a front of the drum and comprising a plurality of sections, each section of the first passage corresponding to the front space of a balancer of the three or more balancers, a second passage provided in the circumferential direction on the front of the drum and comprising a plurality of sections, each section of the second passage corresponding to the rear space of a balancer of the three or more balancers, and a sensor configured to sense unbalance and a location of laundry causing the unbalance, the method comprising:

rotating the drum;

supplying a liquid a first time to the rear space of one or more of the balancers so as to increase the weight at a first target quadrant that is located opposite to a quadrant to which a force causing unbalance is directed on a drum circumferential surface; and supplying the liquid a first time to the front space of one or more of the balancers so as to increase the weight at a second target quadrant that is located opposite to which the force causing unbalance is directed on the drum circumferential surface, wherein the supplying of the liquid the first time to the front space of the one or more balancers starts after the supplying of the liquid the first time to the rear space of the one or more balancers is completed.

17. The control method for the laundry treating apparatus of claim 16, wherein the supplying of the liquid the first time to the rear space comprises:

supplying the liquid a second time to some of the rear spaces so as to increase the weights of two or more different points on the drum circumferential surface located in the first target quadrant; and supplying the liquid a third time to some of the rear spaces so as to increase the weight of one point capable of minimizing the size of unbalance out of the two or more different points.

18. The control method for the laundry treating apparatus of claim 16, wherein the supplying of the liquid the first time to the front space comprises:

supplying the liquid a second time to some of the front spaces so as to increase the weights of two or more different points on the drum circumferential surface located in the second target quadrant; and supplying the liquid a third time to some of the front spaces so as to increase the weight of one point capable of minimizing the size of unbalance out of the two or more different points.

19. The control method for the laundry treating apparatus of claim 17, wherein a size of an unbalance based on the amplitude of an RPM of the drum is measured during the supplying of the liquid the third time.

20. The control method for the laundry treating apparatus of claim 18, wherein a size of an unbalance based on the amplitude of an RPM of the drum is measured during the supplying of the liquid the third time.

* * * * *